United States Patent [19]

Rumrill, Jr. et al.

[11] 4,145,956

[45] Mar. 27, 1979

[54] PILOT OPERATED STEPPING VALVE

[75] Inventors: Edwin W. Rumrill, Jr.; Frank D. Lewis, Sr., both of Atlanta, Ga.

[73] Assignee: The United States of America as represented by the Secretary of the Air Force, Washington, D.C.

[21] Appl. No.: 790,772

[22] Filed: Apr. 25, 1977

[51] Int. Cl.[2] ..... F15B 13/043

[52] U.S. Cl. ..... 91/380; 91/461; 137/625.64

[58] Field of Search ..... 91/365, 368, 380, 461; 137/625.64; 251/30

[56] References Cited

U.S. PATENT DOCUMENTS

| | | | |
|---|---|---|---|
| 2,654,347 | 10/1953 | Clark | 91/380 |
| 3,079,899 | 3/1963 | Inaba et al. | 91/461 X |
| 3,125,002 | 3/1964 | McCombs | 91/365 |
| 3,310,284 | 3/1967 | Inaba et al. | 91/380 |
| 3,709,257 | 1/1973 | Faisandier | 91/461 X |
| 3,805,670 | 4/1974 | Fallows | 91/461 X |
| 3,875,849 | 4/1975 | Patel | 137/625.64 X |
| 3,891,145 | 6/1975 | Bartholomaus et al. | 91/461 X |

*Primary Examiner*—Gerald A. Michalsky

*Attorney, Agent, or Firm*—Joseph E. Rusz; Henry S. Miller

[57] ABSTRACT

A pilot operated stepping valve where an electrical pulse motor drives a pilot valve spool which controls the flow of hydraulic fluid driving a main valve spool which actuates a hydraulic motor or actuator. The main valve spool follows the pilot spool and is hence sensitive to the pulses received by the pulse motor.

2 Claims, 1 Drawing Figure

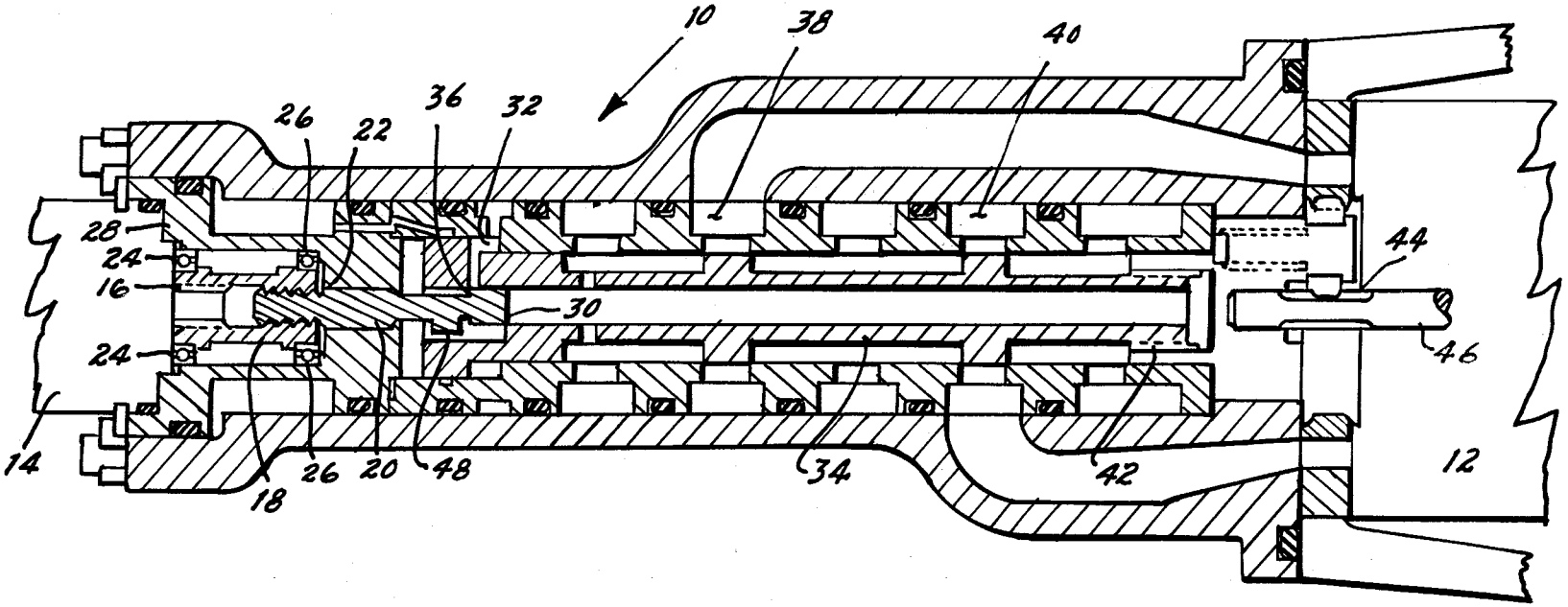
10
12
14
16
18
20
22
24
24
26
26
28
30
32
34
36
38
40
42
44
46
48

PILOT OPERATED STEPPING VALVE

STATEMENT OF GOVERNMENT INTEREST

The invention described herein may be manufactured and used by or for the Government for governmental purposes without the payment of any royalty thereon.

BACKGROUND OF THE INVENTION

The invention relates generally to hydraulic motors and actuators and more specifically to a means for facilitating precise control of such devices.

Hydraulic motors and actuators are well known in industry and control of these devices covers as vast spectrum of art ranging from the simple to the ingenious. The machine tool industry utilizes apparatus most similar to the present invention, wherein computers are utilized to operate large machines. These existing systems are generally quite heavy and operate in a stable environment at relatively low speed and without the need for great sensitivity.

There has been demonstrated a need for hydraulic systems that are light weight, produce high power and are precisely controllable. Electro-hydraulic pulse motor (EPM) units are known in the art, however, currently available devices require extremely high resolution and hence an extremely high pulse rate. This critical requirement adds to the cost of such systems in both materials and design.

To utilize the electro-hydraulic pulse motor effectively and efficiently in an airborne or space borne application, a new pilot operated stepping valve has been developed.

SUMMARY OF THE INVENTION

The invention relates to a reliable, economical device which can transform the low power signals of a digital computer into high power, precisely controlled, mechanical motion. The speed of the hydraulic device, whether a motor or actuator, is proportional to the pulse rate, while the travel or stroke is proportional to the number of pulses.

In the invention an electrical pulse motor, which is designed to be compatable with computer input is operatively attached to a hydraulic stepping valve. The stepping valve functions with a pilot valve spool which is controlled by the electrical pulse motor. Movement of the relatively small pilot valve spool causes a main valve spool to react in kind thus opening or closing flow ports to the hydraulic motor or actuator. Additional gearing may be placed between the valve system and hydraulic motor to reduce the speed that the electrical pulse motor must attain in order to obtain maximum horsepower capacity of the hydraulic motor.

It is therefore an object of the invention to provide a new and improved pilot operated stepping valve.

It is another object of the invention to provide a new and improved pilot operated stepping valve that is more efficient than other similar devices.

It is a further object of the invention to provide a new and improved pilot operated stepping valve that is more efficient than other similar devices.

It is still another object of the invention to provide a new and improved pilot operated stepping valve that is smaller and lighter in weight than known like apparatus.

It is still a further object of the invention to provide a new and improved pilot operated stepping valve that operates on lower electrical power and smaller input control systems than similar valves.

It is another object of the invention to provide a new and improved pilot operated stepping valve that operates at lower pulse rates than existing like apparatus.

It is another object of the invention to provide a new and improved pilot operated stepping valve that facilitates higher hydraulic speeds and power than known devices.

It is another object of the invention to provide a new and improved pilot operated stepping valve which is economical to produce and utilizes conventional, currently available components that lend themselves to standard mass production manufacturing techniques.

These and other advantages, features and objects of the invention will become more apparent from the following description taken in connection with the accompanying drawing.

DESCRIPTION OF THE DRAWINGS

The FIGURE is a cross-sectional view of the invention.

DESCRIPTION OF THE PREFERRED EMBODIMENT

Referring now to the Figure, the valve assembly is contained in a housing shown generally at 10. At one end, the housing is attached to an actuator or hydraulic motor cylinder barrel 12. At the other end is mounted an electrical impulse motor 14, of conventional design, which is ultimately connected to a signal pulse generating computer.

The electrical impulse motor 14 responds to a pulse stream input by causing splined output shaft 16 to rotate. Rotation of the shaft turns nut 18 which engages pilot valve spool 20 by threads 22. Nut 18 is supported by bearings 24 and 26 mounted in the housing 28.

Rotation of nut 18 causes pilot valve spool 20 to translate left or right depending upon which direction electrical pulse motor 14 rotates. Left translation of pilot valve spool 20 causes the pilot valve to open at 30, allowing hydraulic pressure at 32 to move main valve spool 34 to the left until the aperture at 30 closes. Right translation of pilot valve spool 20 opens pilot valve at 36 causing the hydraulic pressure to work on a larger area of main valve spool 34 and move it right.

Thusly, main spool 34 follows pilot spool 20 right or left as if the pilot spool were attached to the main spool. The electrical pulse motor, therefore, supplies the power to move only nut 18 and pilot spool 20 and the hydraulic system supplies the power to move main spool 34. Translation of main spool 34, left or right causes the main valve spool to direct flow to ports 38 and 40 in a manner common for four-way hydraulic valves.

Flow ports 38 and 40 cause the hydraulic device, a hydraulic motor is shown, to move. Motion of the hydraulic device causes the main valve spool 34 to rotate via spline 42. A planetary gear system 44 is provided between hydraulic motor shaft 46 and the main valve spool 34, thereby reducing the speed that the electrical pulse motor must attain in order to obtain maximum horsepower capacity of the hydraulic motor.

When the main valve spool rotates, it causes the pilot valve also to rotate because of spline 48. Rotation of the pilot valve causes it to translate because of threads 22. The sense of the thread arrangement and motor and valve porting is such that the motion of the hydraulic device causes the valve openings 30 and 36 to close. Hence, the hydraulic motor follows the electrical motor pulse for pulse, while the planetary gear system also has the effect of changing the size of the output pulse.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. An electrically actuated, hydraulically powered pilot operated stepping valve for hydraulic motors comprising: a valve housing, having an outer surface adapted to be connected between an electrical pulse source and a hydraulic motor and an inner cylindrical surface including a plurality or ports therein;

an electrical pulse motor connected at one end of the housing, a hydraulic motor connected at the other end of the housing, a pilot valve spindle rotatably mounted in the housing and connected to the electrical pulse motor, for directing the flow of hydraulic fluid;

a main spindle means positioned along an axis common with the said pilot valve spindle adapted to be slidably movable within the cylindrical inner surface of the valve housing;

means for channelling and directing hydraulic fluid in response to movement of the pilot valve spindle toward and away from the main spindle means, and a planetary gear system connected between the hydraulic motor and main spindle whereby the maximum capacity of the hydraulic motor is achieved with reduced electrical pulsed motor speed.

2. A pilot operated stepping valve according to claim 1 wherein the means for connecting the motor means and pilot spindle means is a threaded nut.

* * * * *